United States Patent [19]

Carucci et al.

[11] 4,374,635

[45] Feb. 22, 1983

[54] CASTING INSTALLATIONS

[75] Inventors: Alberto Carucci, Cassino, Italy; Bernard C. Moore, Ohain, Belgium

[73] Assignee: American Standard Inc., New York, N.Y.

[21] Appl. No.: 27,564

[22] Filed: Apr. 6, 1979

[30] Foreign Application Priority Data

Apr. 17, 1978 [IT] Italy ..... 46840 A/78

[51] Int. Cl.[3] ..... B28B 5/04; B28B 1/26

[52] U.S. Cl. ..... 425/441; 249/119; 249/120; 249/124; 249/129; 249/134; 249/141; 249/142; 249/144; 425/217; 425/347

[58] Field of Search ..... 249/119, 122, 124, 129, 249/161, 162, 142, 144, 163, 168, 169, 120, 126, 146–153, 121; 425/88, 259, 261, 414, 416, 441, 577, 581, 588, 346, 347, 182, 195, 348 R, 348 S, 166, 217, 449; 29/428; 164/322; 264/86

[56] References Cited

U.S. PATENT DOCUMENTS

| | | | |
|---|---|---|---|
| 587,728 | 8/1897 | Griffith et al. | 249/126 |
| 952,745 | 3/1910 | Kirk | 264/250 |
| 956,638 | 5/1910 | Hoffer | 249/126 |
| 1,007,623 | 10/1911 | Zwicker | 249/119 |
| 1,109,313 | 9/1914 | Barnes | 264/250 |
| 1,229,873 | 6/1917 | Bowers | 249/126 |
| 1,289,151 | 12/1918 | Gavin | 264/250 |
| 1,476,445 | 12/1923 | Hill et al. | 264/250 |
| 1,642,247 | 9/1927 | Krause | 249/129 |
| 2,573,984 | 11/1951 | Parker et al. | 4/353 |
| 2,583,842 | 1/1952 | Hendrickson | 264/333 |
| 2,983,983 | 5/1961 | Mayer | 249/129 |
| 3,068,490 | 12/1962 | Pokras | 4/353 |
| 3,241,199 | 3/1966 | Rabinovich | 164/29 |
| 3,416,203 | 12/1968 | Ozenne et al. | 425/449 |
| 3,448,496 | 6/1969 | Arnold et al. | 425/449 |
| 3,448,497 | 6/1969 | Arnold et al. | 425/449 |
| 3,506,061 | 4/1970 | Clemm | 249/126 |
| 3,533,593 | 10/1970 | Beck et al. | 249/104 |
| 3,700,204 | 10/1972 | Swett et al. | 249/102 |
| 3,804,361 | 4/1974 | Camus | 249/161 |
| 3,913,908 | 10/1975 | Speyer | 272/123 |
| 3,965,963 | 6/1976 | Phipps et al. | 249/146 |

*Primary Examiner*—Willard E. Hoag

*Attorney, Agent, or Firm*—James J. Salerno, Jr.; Robert G. Crooks; John P. Sinnott

[57] ABSTRACT

A mold unit and method for casting ceramic material in slip form is described. Each mold unit comprises a plurality of parts which when assembled for a casting operation define between them, two casting cavities, the casting cavities are positioned one above the other, into which slip can be introduced to form discrete articles and when removed from the mold while in the green condition are assembled to form a composite article.

6 Claims, 15 Drawing Figures

CASTING INSTALLATIONS

RELATED APPLICATION

Patent application of Kenneth Ernest Goodwin, U.S. Ser. No. 932,149, filed Aug. 9, 1978 for "Casting Installations".

SUMMARY OF THE INVENTION

This invention relates to mold unit, and to installations including a line of mold units, for casting ceramic material in slip form and particularly, although not exclusively, for casting articles of sanitary ware of vitreous china.

According to a first aspect of the present invention there is provided a mold unit for casting ceramic material in slip form, comprising at least three mold parts which are adapted to be assembled for a casting operation to define between them two casting cavities arranged, in the casting position of the mold unit, one above the other, into which slip can be introduced and which correspond respectively to the shapes of discrete articles, one of the mold parts having a core for shaping the article to be cast in the lower cavity of the mold unit and in its upper surface a separate male or female cavity portion forming with a top part of the mold unit, the upper cavity of the mold unit.

Such an installation is particularly suitable for casting two articles which are intended to be assembled during manufacture or which are to be used together, for example a separately cast flushing rim and a closet bowl or a cistern tank and a tank cover.

In one form of the invention, the mold unit is arranged on a support structure and comprises two side mold parts which are separable by relative movement in a generally horizontal direction, the core part which with the two side parts defines the lower of the casting cavities and which is removable from the side mold parts in a substantially vertical direction for removing an article solid cast in that cavity, and the top part which rests on the top of the core part and which defines, with the cavity portion in the upper surface of the core part, the upper casting cavity. In such a mold unit, the casting cavity formed between the two side parts and the core part may be shaped for solid casting of a cistern tank, and the casting cavity formed between the core part and the top part may be shaped to form a cover or lid for the cistern tank; alternatively, the casting cavity formed between the two side parts and the core part may be shaped for solid casting a rimless water closet bowl, and the casting cavity formed between the core part and the top part may be shaped for casting a flushing rim, for example, a box rim for assembly with the closet bowl to make the complete water closet.

In the case where the side mold parts and the core are shaped for solid casting of a cistern tank, the two side mold parts are conveniently designed so that one side part has a substantially vertical cavity surface for forming the back wall of the tank and an integral base for forming the bottom wall of the tank, and the other side part is substantially channel-shaped in plan having substantially vertical cavity surfaces for forming the side walls and the front wall of the tank.

In the case where the side mold parts and the core are shaped for solid casting a closet bowl, the two side mold parts are substantially symmetrical relative to a vertical parting plane and are each shaped to form half the closet bowl.

An advantage of such mold units is that they are suitable for mass production in that a plurality of the mold units may be arranged in a generally horizontal line or bank on a support structure with one side mold part of one mold unit connected to the other side mold part of the next adjacent mold unit in the line, the side mold parts being separated or brought together by relative movement in a horizontal direction longitudinally of the line of mold units. These side mold parts do not have to be lifted bodily at any stage but are simply slid or moved on roller carriers, for example, in the horizontal direction for opening and closing. The only lifting required is of the top mold parts and of the core parts for which there are known lifting devices available; for example, there may be a single lifting device mounted so as to be capable of traversing the whiole line, the lifting device being designed to lift each top mold part and the core mold part, thereby mechanising a hitherto manual operation with a single device.

In another form of the invention, the mold unit is a simple three part assembly for solid casting of cistern tanks and covers for the tanks comprising a lower part having a female cavity portion shaped for forming the exterior surfaces of the bottom, side, front and back walls of the tank, a core part having a core which fits into the lower part and having an upper flange part which rests on the upper rim of the lower part, and a top part which rests on top of the core part and which defines, with the cavity portion in the upper surface of the core part, the upper casting cavity for casting a tank cover.

According to a second aspect the invention provides a mold unit and a method for casting two articles which are intended to be fitted together to form a composite article. In accordance with this aspect of the invention the mold unit comprises at least two parts adapted to be assembled to define between them two casting cavities into which slip can be introduced and which correspond respectively to the shapes of the two discrete articles which, after casting, are capable of interfitting to form a composite article, for example a cistern tank and a lid therefor, or a water closet bowl and a flushing rim therefor. The mold unit may have at least three parts and the two casting cavities arranged between them are preferably arranged, in the casting position of the mold, one above the other, one of the parts having a first cavity portion which forms a boundary of the lower cavity and a second cavity portion disposed in an upwardly facing surface, which forms, with another part of the mold unit, the upper cavity.

The method in accordance with the second aspect of the invention comprises the steps of casting two discrete articles which are capable of interfitting to form a composite article in a mold unit having at least two parts which for casting are assembled to define between them two casting cavities and which correspond respectively to the shapes of the two discrete articles, the casting step comprising filling the mold cavities with slip and allowing a casting time to elapse; the method further comprising opening the respective mold cavities, removing the green cast articles and assembling the two articles while in the green condition into an interfitting relationship.

BRIEF DESCRIPTION OF THE DRAWINGS

The invention may be carried into practice in many ways but certain specific embodiments will now be described, by way of example only, with reference to the accompanying drawings, in which.

DESCRIPTION OF THE PREFERRED EMBODIMENTS

Figure 1:
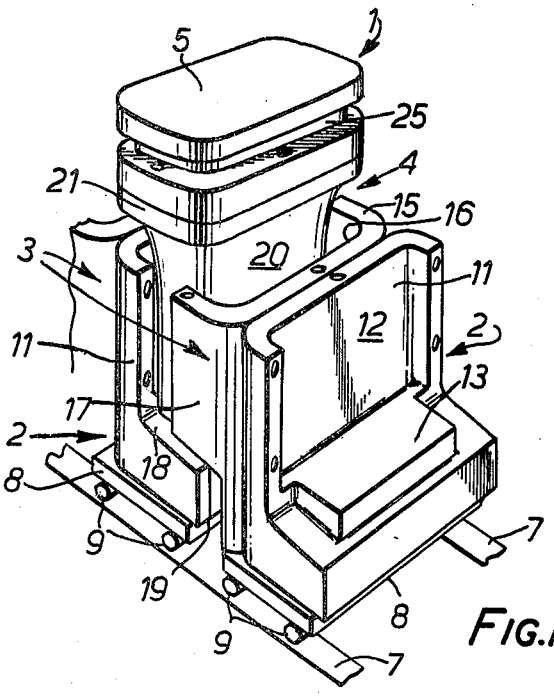
FIG. 1 is a perspective view of a part of a line of mold units for casting cistern tanks and tank covers.
Figure 2:
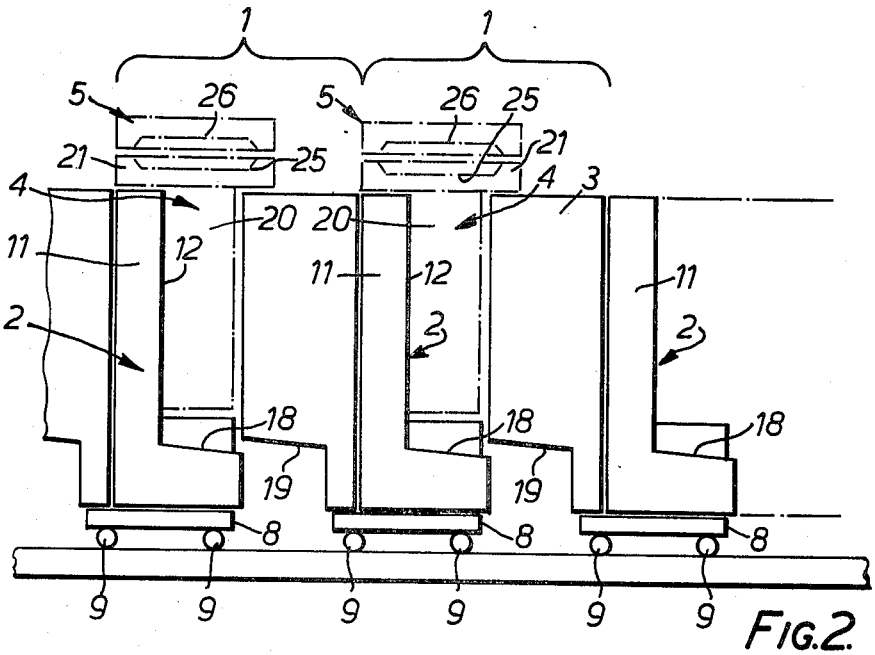
FIG. 2 is a side view of the line of FIG. 1.
Figure 3:
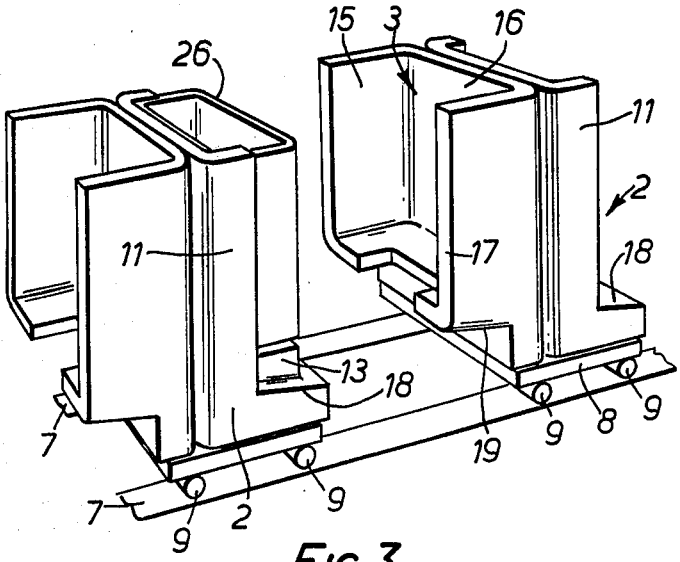
FIG. 3 is a further perspective view of the line of mold units of FIGS. 1 and 2 during emptying.

FIGS. 1 to 3 shows an embodiment for casting of cistern tanks and covers therefor in a line or bank of fifty or more mold units arranged in a horizontal line on a support structure in the form of two rails 7 extending longitudinally of the line.

Each mold unit 1 consists of four main mold parts: two side parts 2 and 3, a core part 4 and a top part 5. The side parts 2 and 3 are supported on carriers 8 fitted with rollers 9 so that they can be moved easily on the rails 7 in a longitudinal direction of the line. The side parts 2 each comprise an upstanding part 11 having a surface 12 which shapes the external surface of the back wall of the tank and a base part 13 which forms the bottom of the tank. The side parts 3 each comprise upstanding mold walls 15, 16 and 17 which form a channel shape as viewed in plan, the inside faces of which form the external surfaces of the side and front walls of the tank.

Each pair of side parts 2 and 3 of the same mold Unit 1 can be brought together to define the casting cavity, the lower side edges 18 and 19 being inclined to the horizontal to allow the parts to be separated directly by movement in a horizontal direction without the mold parts scraping against each other.

In the line of mold units, each side part 2 is connected rigidly in back-to-back relation with the side part 3 of the next adjacent mold unit in the line.

The core part 4 for each mold unit comprises a core 20 depending from a rim 21 which when the mold unit is assembled rests on the upper edges of the side parts 2 and 3 which lie in a common plane. The core part 4 is adapted to be lifted vertically above the line during emptying or lowering so that the core 20 is located between the side parts 2 and 3 in the assembled condition of each mold unit.

The upper surface of each core part 4 has in it a cavity portion 25, female or male, of a discrete casting cavity for shaping the tank cover, the corresponding other portion 26, male or female, being provided in the underside of the top part 5 of each mold unit.

In operation, the mold units 1 of the entire line are assembled by closing up the side parts 2 and 3 and lowering the core parts 4 and the top parts 5. The line of mold units 1 is then clamped longitudinally by an overall clamping arrangement at each end of the line, not shown. The core parts 4 and top parts 5 may be held by clamping or other hold-down-means, which may be common to all the mold units, or the core parts 4 and the top parts 5 may be sufficiently heavy simply to rest on the side parts 2 and 3 without risk of the core moving when the mold unit is filled with slip under pressure.

The mold units 1 are then filled with slip, the slip flowing from a slip supply tank under gravity into both casting cavities in each mold unit 1; the inlets for the casting cavities may be discrete apertures in the mold wall or the cavities may communicate with each other by a suitable duct within the mold unit itself.

After a suitable casting time has elapsed, during which time moisture is absorbed by the plaster of the molds, the molds are opened. The procedure is first to remove all the top parts 5 to expose the green cast tank covers. The core parts 4 with the cover still in situ are then lifted by a suitable lifting means which is capable of traversing along the whole line of mold units.

The overall clamping of the side parts is then released and, dealing with each mold unit in turn, the side parts are separated by moving side part 3 away from side part 2 on which the tank rests on the base part 13. The tank 26, shown in FIG. 3, is then removed using suitable tongs or similar tools and placed on a rack at one side. The emptied side part 2 is then pulled along the track which movement simultaneously pulls the side part 3 of the next mold unit to open that mold unit.

After removing all the tanks 26, the core parts 4 are lowered and the tank covers which have remained on top of the core parts 4 and which have started to dry are removed in turn and if possible are each placed directly on each corresponding cistern tank 26.

It will be appreciated that the particular design of the side parts 2 and 3 enables the cistern tanks to be cast in a line or bank casting installation and there are clear advantages in this.

Figure 4:
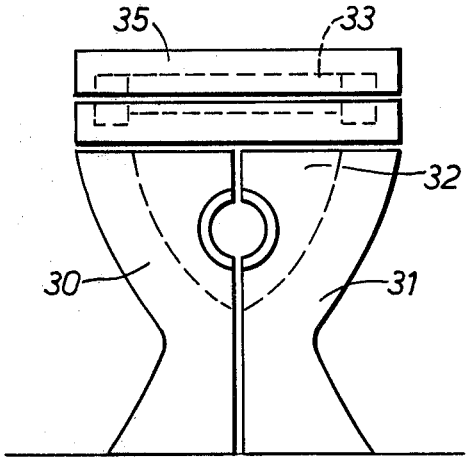
FIG. 4 is a side view of a mold unit for casting a closet bowl and a flushing rim therefor.

FIG. 4 shows diagrammatically another example of casting two articles in the same mold unit, a core-cast rimless closet bowl cast between side mold parts 30 and 31 and a core piece 32, and a separate flushing rim, for example a box rim, cast in a discrete casting cavity 33 formed between the upper face of the core piece 32 and a top part 35. As with the mold units in FIGS. 1 to 3, the parts are adapted to be assembled or opened by horizontal relative movement of the side parts 30 and 31, and vertical movement of the top part 35 relative to the core piece 32 and of the core piece 32 itself relative to the side parts 30 and 31.

The only difference in this example is that once the closet bowl and rim have been cast, they are joined together while still in the green condition to form a complete closet bowl with an integral flushing rim.

Figure 5:
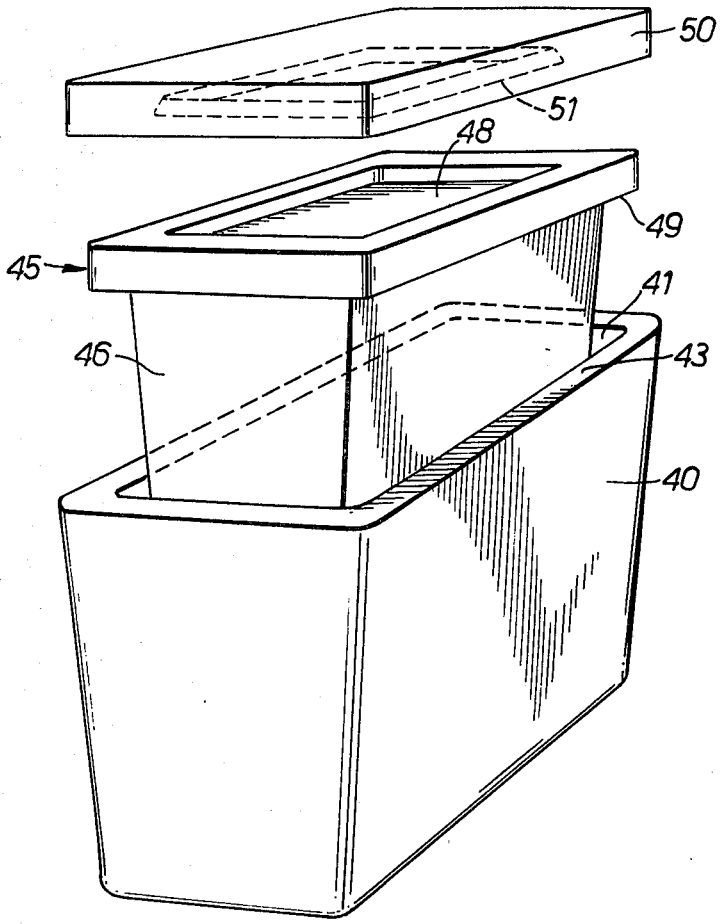
FIG. 5 is a view of an embodiment of a three-part mold unit for solid casting a cistern tank and a cover for the tank.

The last embodiment, shown in FIG. 5, is an example of casting a cistern tank and its cover in the same mold unit made up of three parts adapted to be separated in a vertical direction. The lower part 40 has the lower casting cavity portion 41 for shaping the external surfaces of the cistern tank. The intermediate mold part 45 has an integral core piece 46 adapted to fit within the cavity portion 41, and, in its upwardly facing surface, a discrete cavity portion 48 for shaping the lower surface of the tank cover. The top part 50 fits over the upper surface of the core part 45 and has in its underneath surface a cavity portion 51 which shapes the upper surface of the tank cover and which with the upper surface of the core part 45 defines the entire cover casting cavity.

For casting, the intermediate core part 45 is lowered onto the lower part 40 with a downwardly presented rim 49 of the core part 45 resting on the upper rim 43 of the lower part, so that the tank casting cavity is formed, and the top part 50 is then placed on the upper surface of the core part 45. The assembly may then require clamping, or the weight of the parts themselves may make clamping unnecessary.

In operation, the casting cavities are filled either at separate inlets or by a single inlet and an internal communicating duct, from a common slip supply, a casting time is allowed and then the top mold part 50 and the core part 45 are lifted vertically above the lower part by suitable lifting apparatus. The cistern tank is then removed from the cavity portion 41 using a pair of tongs or the like by drawing the tank carefully out in an upward direction clear of the lower mold part 40, and the tank is placed on a rack at one side. The upper rim of the tank is then dusted with a releasing or non-stick agent. The core part 45 and top part 50 with the tank cover therein are then lowered into the empty lower part 40, the top part 50 lifted off and then the tank cover is removed from the top of the core part, using a hand-held suction lifting device, and placed carefully onto the tank. The tank and its cover then proceed to the various finishing operations.

What is claimed:

1. A mold unit for casting ceramic material in slip form, comprising a plurality of mold parts which are adapted to be assembled for a casting operation to define between them two casting cavities arranged, in the casting position of the mold unit, one above the other, into which slip can be introduced and which correspond respectively to the shapes of discrete articles, one of the mold parts having a core for shaping the article to be cast in the lower cavity of the mold unit and in its upper surface a separate cavity portion forming, with a top part of the mold unit, the upper cavity of the mold unit; said lower mold cavity being defined by two cooperating side mold members, each having a horizontal cross-section of two channel-shapes, back to back, two of said channel-shapes facing each other to form said lower cavity, and each of the remaining channel-shapes of said mold member being adapted to cooperate with adjacent mold members to form a succession of similar units, the base of each said mold unit being defined by but one of said mold members.

2. A mold unit for casting ceramic material in slip form comprising at least two parts adapted to be assembled to define between them two casting cavities into which slip can be introduced and which correspond respectively to the shapes of the two discrete articles which, after casting, are capable of interfitting to form a composite article; and one of said cavities being defined by two cooperating side mold members, each having a horizontal cross-section of two channel-shapes, back-to-back, two of said channel-shapes facing each other to form said one cavity, and each of the remaining channel-shapes of said mold member being adapted to cooperate with adjacent mold members to form a succession of similar units, the base of each said mold unit being defined by but one of said mold members.

3. A plaster mold unit, horizontally arranged in a casting position, for casting ceramic material in slip form, and adapted to form a segment of a mold cavity of an adjacent mold unit, each mold unit comprising a plurality of mold parts which are adapted to be assembled for a casting operation to define between them two casting cavities arranged, in the casting position of the mold unit, one above the other, and having means through which slip can be introduced, and which correspond respectively to the shapes of discrete articles, one of the mold parts having a core for shaping the article to be cast in the lower cavity of the mold unit and in its upper surface, a separate cavity portion forming, with a top part of the mold unit, the upper cavity of the mold unit.

4. The mold unit of claim 3 wherein said plurality of mold parts is at least 3.

5. The mold unit of claim 3 wherein the lower cavity is shaped for unitary casting a cistern tank of a water closet and the upper cavity is shaped for casting a cover for the tank, the mold unit comprising a lower part having a female cavity portion shaped for forming the exterior surfaces of the bottom side, front and back walls of the tank, an upper mold part including a core which fits into the lower part and having an upper flange part which rests on the upper rim of the lower part, and a top part which rests on top of the core part and which defines, with a cavity portion in the upper surface of the upper mold part, the upper casting cavity for casting the tank cover.

6. A plaster mold unit, horizontally arranged in a casting position, for casting ceramic material in slip form, and adapted to form a segment of a mold wall of an adjacent mold unit, each mold unit comprising at least three mold parts which are adapted to be assembled for casting operation to define between them two casting cavities arranged, in the casting position of the mold unit, one above the other, and having means through which slip can be introduced, and which correspond respectively to the shapes of discrete articles, one of the mold parts having a core for shaping the article to be cast in the lower cavity of the mold unit and in its upper surface a separate cavity portion forming, with a top part of the mold unit, the upper cavity of the mold unit, said lower cavity being shaped for unitary casting of a cistern tank of a water closet and the upper cavity being shaped for casting a cover for the tank, the mold unit includes a lower part having a female cavity portion shaped for forming the exterior surfaces of the bottom, side, front and back walls of the tank, a core part having a core which fits into the lower part and having an upper flange part which rests on the upper rim of the lower part, and a top part which rests on the top of the core part and which defines, with the cavity portions in the upper surface of the core part, the upper casting cavity for casting the tank cover and said mold unit being arranged to form a horizontal line of mold units whereby the top mold part and the core part of each mold unit in sequence is capable of being removed by a single lifting device adapted to be coupled to each top mold part.

* * * * *